US007779487B1

(12) United States Patent
Bitzer

(10) Patent No.: US 7,779,487 B1
(45) Date of Patent: Aug. 24, 2010

(54) GLOVE WITH SOFT FEEL AND HIGH WEAR RESISTANCE

(76) Inventor: Robert Bitzer, 950 Enchanted Way, Suite 104, Simi Valley, CA (US) 93065

( * ) Notice: Subject to any disclaimer, the term of this patent is extended or adjusted under 35 U.S.C. 154(b) by 196 days.

(21) Appl. No.: 11/805,959

(22) Filed: May 24, 2007

(51) Int. Cl.
*A41D 19/00* (2006.01)

(52) U.S. Cl. ..... 2/161.6; 2/159; 2/167; 2/16; 2/20; 2/21

(58) Field of Classification Search ..... 2/16, 2/20, 158, 159, 161.1, 161.3, 161.5, 161.6, 2/161.7, 161.8, 163, 164, 167
See application file for complete search history.

(56) References Cited

U.S. PATENT DOCUMENTS

| | | | | |
|---|---|---|---|---|
| 4,004,295 | A | 1/1977 | Byrnes, Sr. | |
| 5,442,815 | A | 8/1995 | Cordova et al. | |
| 5,442,816 | A * | 8/1995 | Seketa | 2/161.7 |
| 5,568,657 | A | 10/1996 | Cordova et al. | |
| 5,740,551 | A * | 4/1998 | Walker | 2/16 |
| 5,822,791 | A * | 10/1998 | Baris | 2/2.5 |
| 5,876,834 | A * | 3/1999 | Foy et al. | 428/192 |
| 5,925,441 | A * | 7/1999 | Blauer et al. | 428/196 |
| 5,935,882 | A * | 8/1999 | Fujita et al. | 442/247 |
| 6,021,523 | A | 2/2000 | Vero | |
| 6,127,291 | A | 10/2000 | Coppage, Jr. et al. | |
| 6,760,924 | B2 | 7/2004 | Hatch et al. | |
| 6,912,732 | B2 | 7/2005 | Hatch et al. | |
| 7,151,129 | B2 | 12/2006 | Ishikawa et al. | |
| 7,152,249 | B2 * | 12/2006 | Geng | 2/161.6 |

(Continued)

FOREIGN PATENT DOCUMENTS

| | | |
|---|---|---|
| CA | 2005413 | 12/1989 |

(Continued)

OTHER PUBLICATIONS

Nam Liong Entriprise, Co., LTD; ARMORTEX; Abasion Resistant Series (Brief Introduction); Printed Apr. 19, 2007; 2 pages.

(Continued)

*Primary Examiner*—Gary L Welch
*Assistant Examiner*—Sally C Cline
(74) *Attorney, Agent, or Firm*—David L. Hoffman; Law Offices of David L. Hoffm

(57) ABSTRACT

A glove used for roping steer and other animals such as in rodeo competition and ranching has a front side, which covers a wearer's palm and a palm side of the wearer's fingers, and a back side, which covers the wearer's hand and the back of the wearer's fingers. The front and rear sides of the glove are joined by thread. The front side is made of a woven fabric that has an outer layer of one hundred percent aramid fiber such as Kevlar®, and an inner layer of a woven and breathable fiber, the inner layer and outer layer being joined by glue. The fibers are preferably in yarn form. Both the inner and outer layer along with the glue have a weight of about 245 gm/m$^2$ of material, plus or minus 50 gm/m$^2$ of material. The wearer holds the rope having it rest on the middle finger and guides the rope with the index finger and thumb.

3 Claims, 3 Drawing Sheets

U.S. PATENT DOCUMENTS

| | | | | |
|---|---|---|---|---|
| 7,498,276 | B2 * | 3/2009 | Wagner et al. | 442/59 |
| 2003/0208833 | A1 | 11/2003 | Gold | |
| 2005/0009429 | A1 * | 1/2005 | Park et al. | 442/181 |
| 2005/0114983 | A1 | 6/2005 | Demay et al. | |
| 2005/0183184 | A1 | 8/2005 | Hatch et al. | |
| 2005/0268374 | A1 * | 12/2005 | Mattesky | 2/164 |
| 2006/0062944 | A1 * | 3/2006 | Gardner et al. | 428/34.1 |
| 2007/0169247 | A1 * | 7/2007 | Mordecai et al. | 2/81 |
| 2007/0204373 | A1 * | 9/2007 | Loyens et al. | 2/16 |
| 2008/0005826 | A1 * | 1/2008 | Lenhart | 2/160 |
| 2009/0137176 | A1 * | 5/2009 | Okuya et al. | 442/189 |
| 2009/0174178 | A1 * | 7/2009 | Lenhart | 280/821 |
| 2009/0233075 | A1 * | 9/2009 | Link et al. | 428/220 |
| 2010/0038956 | A1 * | 2/2010 | Byers et al. | 301/37.25 |

FOREIGN PATENT DOCUMENTS

| | | |
|---|---|---|
| CA | 2154244 | 7/1995 |
| CA | 2501212 | 10/2003 |

OTHER PUBLICATIONS

Nam Liong Entriprise, Co., LTD; ARMORTEX; Abasion Resistant Series (KN-202A Material); First Printed Apr. 19, 2007; 1 page.

Akona 1 MM Bug Hunter Premuim ArmorTex Gloves for Lobster Diving (Large); Printed Apr. 19, 2007; 4 pages; Amazon.com.

Ruppenicker George F. & Kullman, Russell M.H., High Cotton-Content Polyester/Kevlar Triblend Yarns and Fabrics; 1982; Textile Research Journal, vol. 52, No. 5, 344-348; 2 pgs.

United Glove, GA 1024 Kevlar Canvas; www.unitedglove.com; First Printed Apr. 19, 2007; 1 page.

United Glove, GA236FL Fingerless Industrial Weight Kevlar Knit; www.unitedglove.com; First Printed Apr. 19, 2007; 1 page.

United Glove, GA54ADG All Double Kevlar Hot Mill Cotton Lining Guantlet Cuff; www.unitedglove.com; First Printed Apr. 19, 2007; 1 page.

* cited by examiner

GLOVE WITH SOFT FEEL AND HIGH WEAR RESISTANCE

BACKGROUND OF THE INVENTION

1. Field of the Invention

The present invention generally relates to gloves providing a soft feel yet a high wear resistance, and more specifically to such gloves for roping.

2. Description of the Related Art

In roping, such as roping steer and other animals such as in for rodeo competition or ranch work, the ropers generally prefer soft cotton-knit gloves. These gloves are great for providing good feel of the rope. A shortcoming of these gloves is their extreme lack of durability. Such cotton gloves usually wear out within as few as one or two uses.

Some attempts at providing more durable roping gloves have been made. For example, there is a roping glove made of a composite material believed to be polyurethane and nylon, with a small amount of pieces of aramid fiber mixed in, and possibly some Spandex®. While the glove achieves some increased durability, the glove has a rough interior and very rough exterior. The roughness of the glove does not allow for the comfort and especially the feel that is preferred by ropers. This glove shows that increasing the amount of aramid fiber would provide less feel, less comfort and increased stiffness, so as not to be useful for roping.

Other durable gloves have been invented using Kevlar®, e.g., in U.S. Pat. No. 4,000,295 to Byrnes, Sr. However, in most cases these gloves are made for uses such as handling knives and other sharp objects. In such cases, the gloves are very durable, but do not give the user much comfort or feel. There is a need for a glove that will allow the user to maintain the same feel and comfort provided by a cotton glove yet durable enough to withstand the wear and tear caused by the rope.

SUMMARY OF THE INVENTION

In one embodiment, the present invention provides a roping glove having an outer layer on a front side, i.e., the palm side that is made of 100% aramid fiber material.

An interior layer of the glove is preferably a polyester knit. Preferably, the layers are roughly of equal thickness, both being relatively thin, flexible layers. The combination of these materials provides for a flexible yet durable glove that has substantially the same feel as a standard cotton roping glove, and is also breathable.

The back side of the glove has two portions, one just below the knuckles and the other on each digit. These portions are preferably made of a stretch nylon material (e.g., Spandura®). The material is soft, flexible and durable. This allows for fairly unrestricted movement by the wearer. The glove also preferably has two leather portions, one over the knuckle and the other in-between the thumb and index fingers of the glove.

DESCRIPTION OF THE PREFERRED EMBODIMENT(S)

In a preferred embodiment, there is a roping glove with a portion having a 100% aramid fiber (e.g., Kevlar®) outer layer. The glove is very durable and provides for the same or substantially the same feel that a standard cotton roping glove provides.

Figure 1:
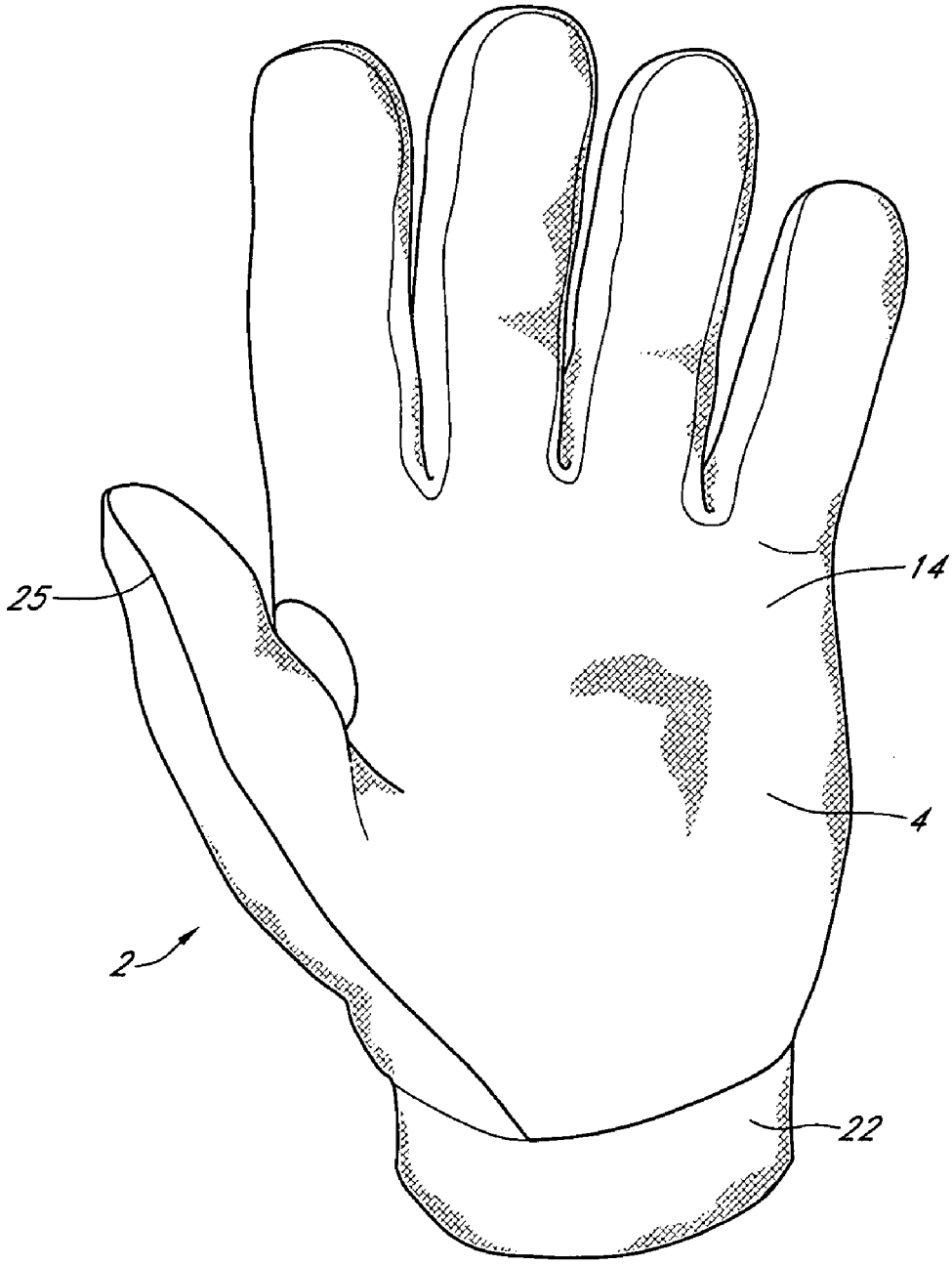
FIG. 1 is a view of a front, palm side of a glove in accordance with a preferred embodiment of the invention showing a 100% aramid fiber layer thereon.
Figure 2:
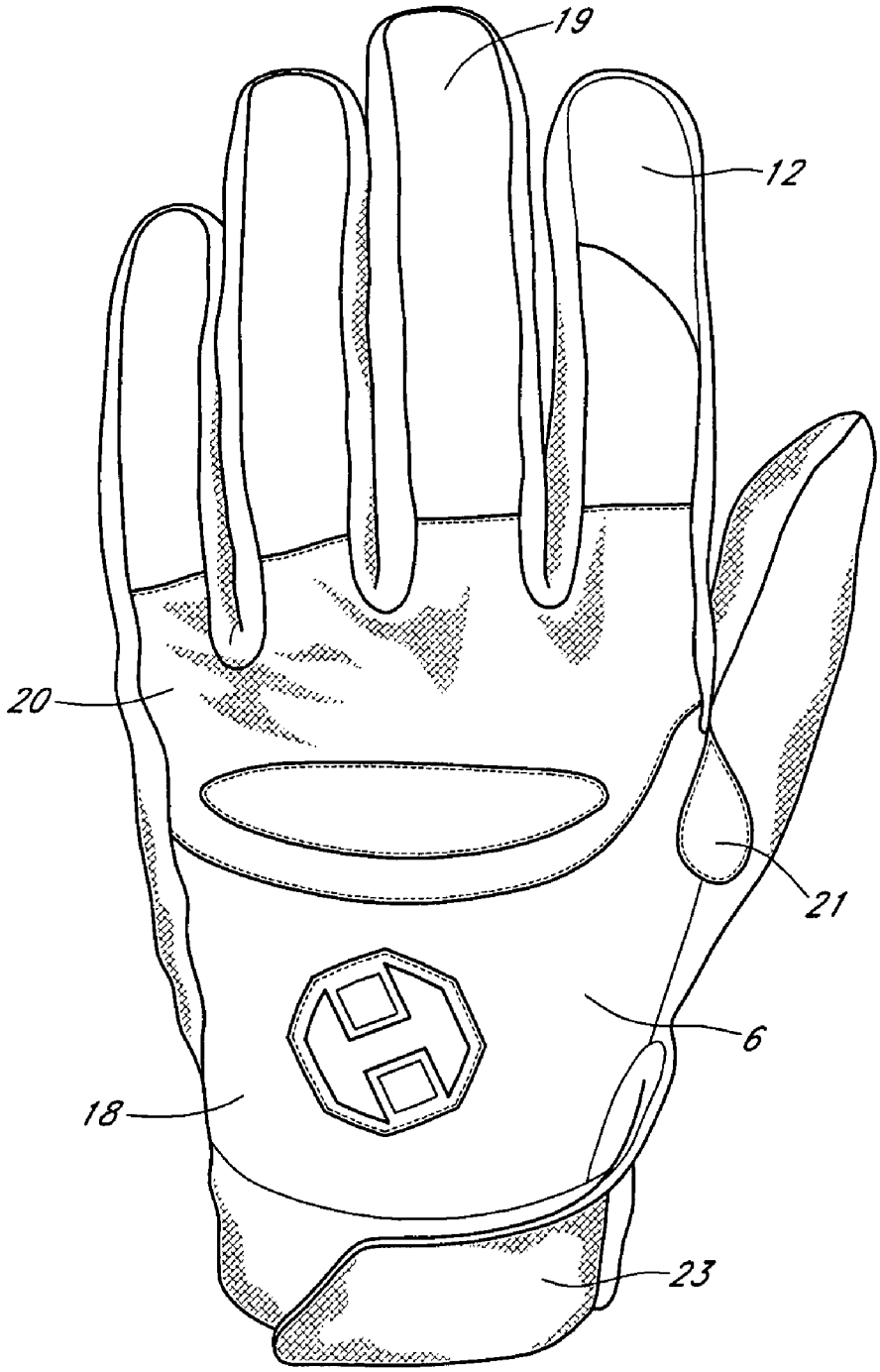
FIG. 2 is a view of a back side of a glove in accordance with a preferred embodiment of the invention.

As shown in FIGS. 1 and 2, glove 2 has a front or palm side 4 and a back side 6. Palm side 4 is formed of a layered woven materials having an exterior layer 14 made of 100% aramid fiber (aramid fiber is also known as aromatic polyamide). Back side 6 of the glove preferably has several different materials. There are two portions 18 and 19 that are preferably made of a combination of nylon and spandex, e.g., Spandura®. The Spandura® material allows for a soft form-fitting material to be used that is also abrasion resistant. However, other flexible and durable synthetic fibers may be suitable.

There are also two portions of back side 6 that are preferably made of leather. One portion 20 is located over the knuckles and another portion 21 is located in-between the index finger and thumb of the glove. While it is preferred that these portions 20, 21 be made of leather, other materials would be suitable. There is also a portion on index finger 12 in which the aramid and polyester layers from the palm side are folded over in order to protect the wearer when he/she is handling a rope. The aramid and polyester layers also preferably fold over onto a side of the palm and pinky 24, in order to provide further protection for the wearer.

Palm side 4 and back side 6 of glove 2 are stitched together using thread 25, as is well known in the art.

In a preferred embodiment, glove 2 is secured using an elastic strap 22 that wraps around a wrist of the wearer. Strap 22 has a Velcro® (hook and loop material) portion 23 to close and snugly secure to a variety of different sized wrists. Any other typical means of securing the glove to the user, such as a snap, may also be used.

Figure 3:
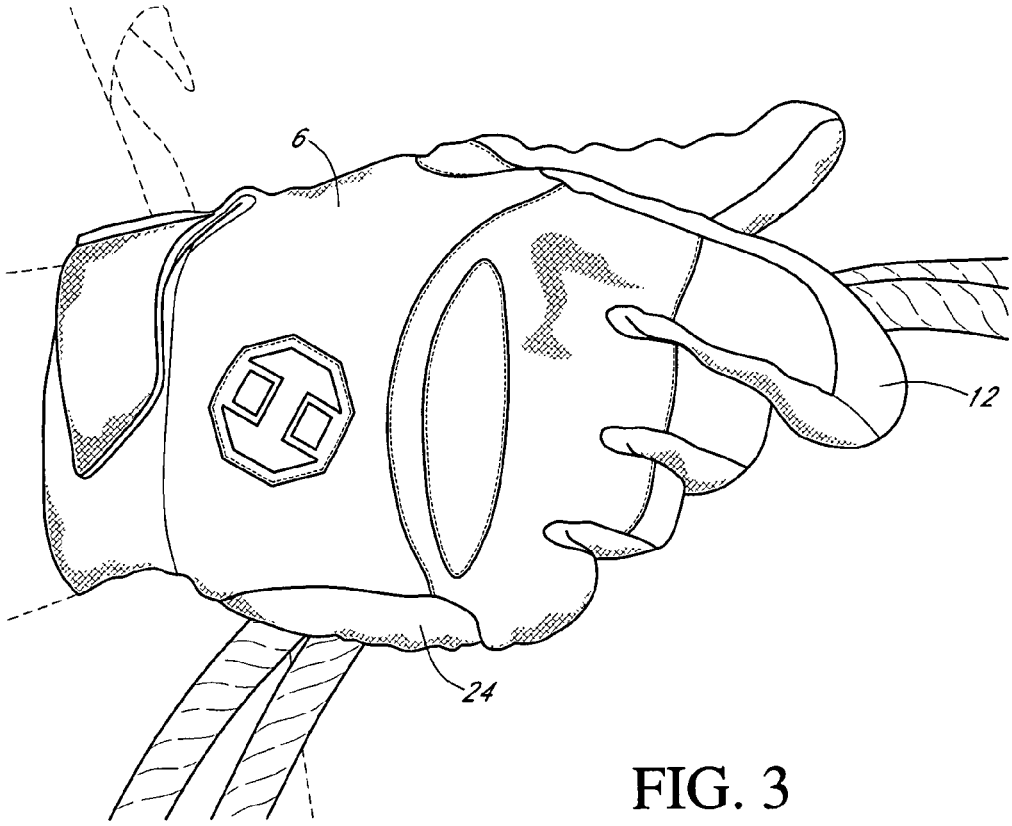
FIG. 3 is a side view of a portion of a cowboy holding a rope or lasso using a glove of the type shown in FIGS. 1-2.

FIG. 3 shows glove 2 in use by a roper. The rope rests on the middle finger and is guided by the thumb and index finger. The rope slides through the roper's hand making contact with the inside of the fingers and palm, as well as the sides of the index and middle fingers. The aramid layer 14 and polyester layer 16 of glove 2 are made to cover the inside and about half the side of every finger so that any portion of the roper's hand that may make contact with the rope is protected by the aramid layer.

Figure 4:
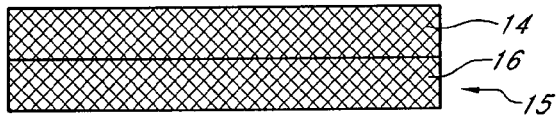
FIG. 4 is a schematic sectional view taken along a line 4-4 of FIG. 1 showing the aramid fiber layer and an inner layer of a material used on the front (palm side) of the glove.

In a preferred embodiment, the composite layer material 15 of FIG. 4 is also rolled over the end of index finger 12 in case the rope rolls over the index finger.

The interior layer of material 15 is preferably made of a polyester fiber. A fiber that is comfortable, durable and breathable could also be used. As shown in FIG. 4, aramid fibers 14 and polyester fibers 16 are roughly the same thickness, most preferably about 1 to 1.5 mm. Both fiber layers are woven so as to leave some spaces for breathability, preferably. Such breathability, by leaving spaces, is preferably comparable to cotton. The layers could be slightly thicker or thinner and preferably are less than about 2 mm. A large thickness would lose the feel achieved and too thin a layer would lose strength. Layers 14 and 16 are held together by coating them with a relatively non-stick and abrasion-resistant glue. The layers combined with the glue make for a preferred weight of about 245 gm/m$^2$ of material. However, approximately 50 gm/m$^2$ of material could be gained or lost and still achieve similar desired feel and protection.

Conventional wisdom would teach that a glove having a 100% aramid layer would be too stiff to use in roping and would have very little if any feel. However, aramid layer 14 on palm side 4 is relatively thin and is woven in a way that allows the fabric to be soft, breathable and flexible. Also inside layer 16 is preferably a thin polyester weave or knit that gives the wearer the feel of cotton.

Back side 6 of glove 2 is preferably a material that is a durable stretch nylon (e.g., Spandura®). This material also provides for a flexible, soft feel without taking away from the durability of the glove. Other materials that would achieve this amount of flexibility and durability may be used. The entire glove 2 is a flexible glove with the same or substantially the same feel as a standard cotton roping glove yet can last for hundreds of uses.

Knitting the fabric as opposed to weaving may also be suitable, although weaving is preferred. The aramid fiber is preferably in yarn form, e.g., flattened yarn filament, so as to enable weaving in a manner providing for air flow and softness, but can be a thread, or mixture.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be changed in whole or in part.

What is claimed is:

1. A glove for roping comprising:

(a) a front side for covering a palm and a palm side of a wearer's fingers;

(b) a back side for covering a back of wearer's hand and a back of a wearer's fingers;

(c) means for joining the front side and back side of the glove; and (d) wherein the front side consists of a textile material having (i) an outer layer consisting of aramid fiber, (ii) an inner fiber layer consisting of polyester, (iii) glue for joining the inner layer and outer layer; and wherein the textile material has a weight of from 195 gm/m$^2$ to 295 gm/m$^2$ of material, wherein the outer layer of the front side of the glove is 1 to 1½ mm in thickness, wherein the inner layer of the front side of the glove is 1 to 1½ mm in thickness, and wherein at least one half of a side of the palm as well as at least one half of each side of each finger are comprised of the textile material used on the palm side of the glove.

2. The glove of claim 1, wherein the back side is formed at least one half by a stretch nylon material.

3. The glove of claim 1, wherein the back side of the index finger is partially comprised of the textile material used on the palm side of the glove wrapped around the index finger.

* * * * *